US006335596B1

(12) United States Patent
Hsu et al.

(10) Patent No.: US 6,335,596 B1
(45) Date of Patent: Jan. 1, 2002

(54) CONTROL DEVICE OF A FLASH TYPE MOVABLE DECORATING LAMP

(76) Inventors: Chin Yung Hsu, 4F, No. 7, Lane 10, Sec. 3, Hsin Sheng S. Rd.; Leo Lin, 3F, No. 123, Wuchiuanshi 5th St., both of Taichung (TW)

( * ) Notice: Subject to any disclaimer, the term of this patent is extended or adjusted under 35 U.S.C. 154(b) by 0 days.

(21) Appl. No.: 09/587,324

(22) Filed: Jun. 5, 2000

(51) Int. Cl.[7] ..... H05B 37/00

(52) U.S. Cl. ..... 315/200 A; 315/227 R; 315/241 P

(58) Field of Search ..... 315/200 A, 323, 315/185 R, 187, 188, 241 P, 241 S, 227 R

(56) References Cited

U.S. PATENT DOCUMENTS 3,753,039 A * 8/1973 Bonazoli et al. ..... 315/227

* cited by examiner

*Primary Examiner*—David Vu
(74) *Attorney, Agent, or Firm*—Rosenberg, Klein & Lee

(57) ABSTRACT

A control device of a flash type movable decorating lamp comprises a high voltage converting circuit, an actuating circuit, a high voltage storage capacitor, a flash displaying circuit and other units. The time difference between charging and discharging of the high voltage converting circuit to the high voltage storage capacitor and the voltage difference for the triggering of the flash lamp tubes are used to replaced a movable decorating lamp sequential control circuit. Part of the storage capacitor and each the flash lamp high voltage generating circuit are used in common so as to achieve the object of simplifying part of the circuit and the manufacturing process becomes more economic.

4 Claims, 5 Drawing Sheets

CONTROL DEVICE OF A FLASH TYPE MOVABLE DECORATING LAMP

FIELD OF THE INVENTION

The present invention relates to a control device of a flash type movable decorating lamp, and especially to a movable decorating lamp control circuit for replacing a movable decorating lamp sequential control circuit in which part of the storage electric energy and high voltage generating circuit of each flash lamp are used in commom.

BACKGROUND OF THE INVENTION

If a conventional flash lamp circuit to be designed as a movable decorating lamp having sequentially variations, as shown in FIGS. 1 and 2, other than a circuit unit formed by a high voltage converting circuit 60, high voltage storing capacitance 65, a trigger circuit 70, a flash lamp tube 75, and a high voltage triggering coil 80, a further sequential control circuit of a movable decorating lamp is necessary (including a N loops movable decorating lamp control circuit and a flash lamp 1–N). As shown in FIG. 3, after integrating the aforesaid two units, the whole structure is bulky and heavy, the economic efficiency in manufacturing is low.

Therefore, there is an eager demand for a novel designed movable decorating lamp sequential control circuit, in which part of the storage electric energy and high voltage generating circuit of each flash lamp are used in common.

SUMMARY OF THE INVENTION

Accordingly, the primary object of the present invention is to provide a control device of a flash type movable decorating lamp comprising a high voltage converting circuit, an actuating circuit, a high voltage storage capacitor, a flash displaying circuit and other units. The time difference between charging and discharging of the high voltage converting circuit to the high voltage storage capacitor and the voltage difference for the triggering of the flash lamp tubes are used to replaced a movable decorating lamp sequential control circuit. Part of the storage capacitor and each the flash lamp high voltage generating circuit are commonly used so as to achieve the object of simplifying part of the circuit and the manufacturing process becomes more economic.

Another object of the present invention is to provide a control device of a flash type movable decorating lamp, wherein all the flash lamp high voltage converting circuits are commonly used, as different power system is used, only the high voltage converting circuit is necessary to be updated.

A further object of the present invention is to provide a control device of a flash type movable decorating lamp. Thereby, it can be used in advertisement, indication, light effect in platform, etc.

The various objects and advantages of the present invention will be more readily understood from the following detailed description when reading in conjunction with the appended drawing.

DETAILED DESCRIPTION OF THE PREFERRED EMBODIMENTS

Figure 1:
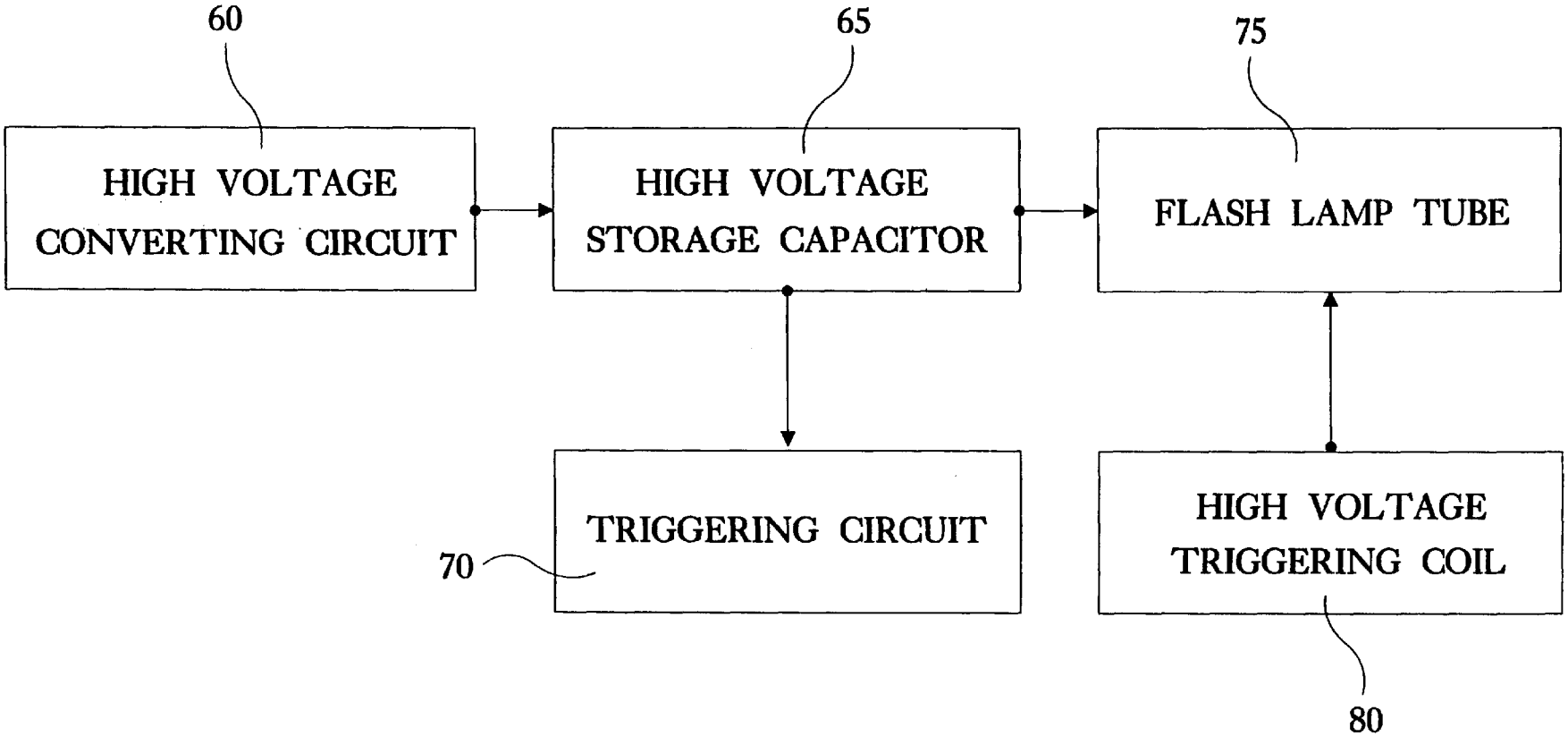
FIG.1 PRIOR ART
FIG. 1 is a block diagram of a conventional flash lamp control circuit.
Figure 2:
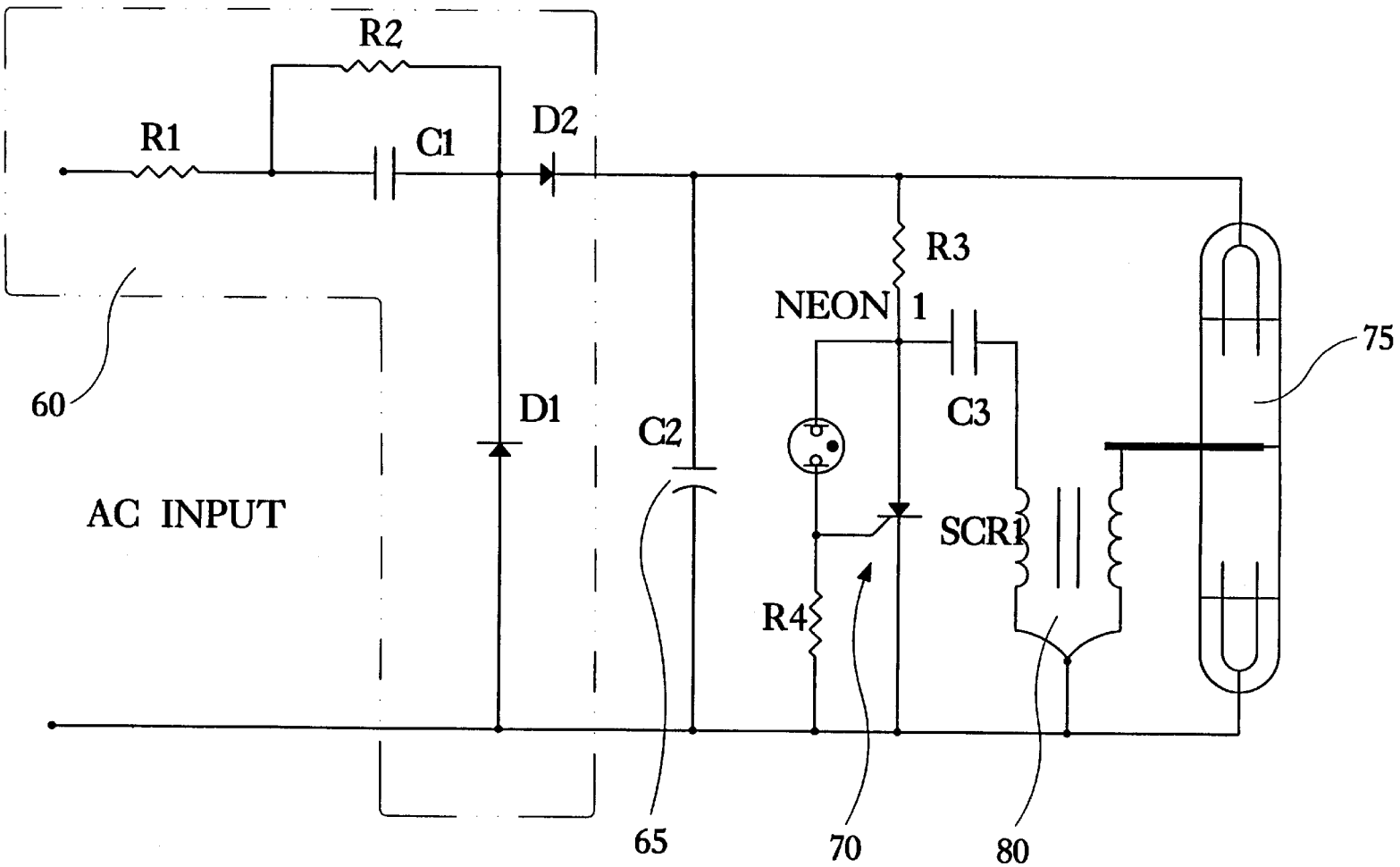
FIG.2 PRIOR ART
FIG. 2 is a circuit diagram of a conventional flash lamp.
Figure 3:
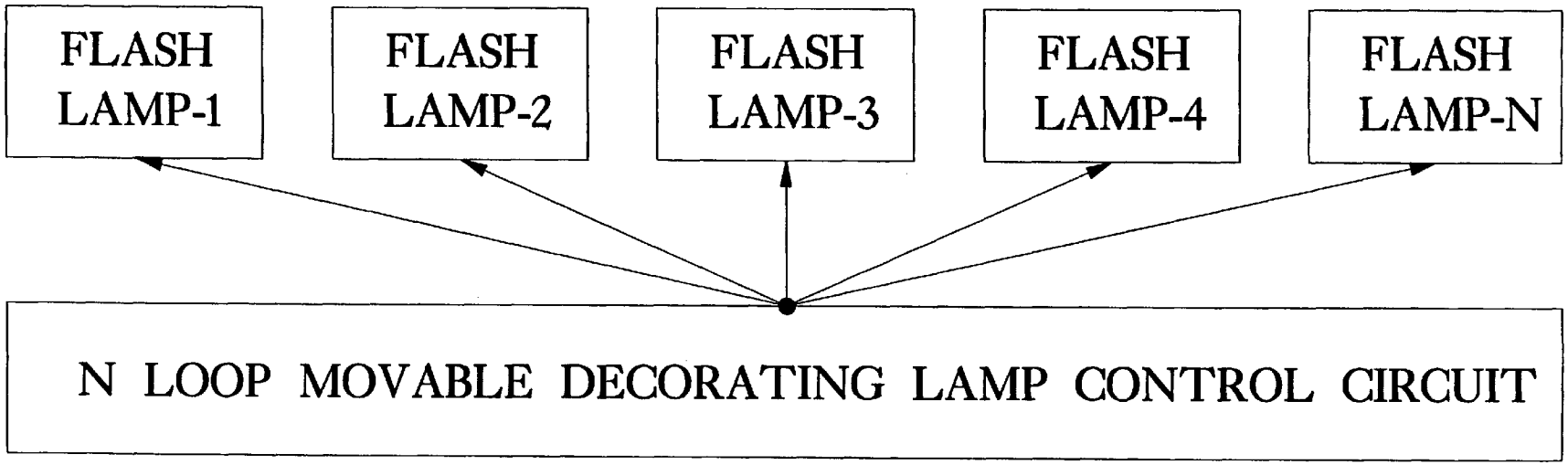
FIG.3 PRIOR ART
FIG. 3 is a circuit block diagram of a conventional flash type movable decorating lamp.
Figure 4:
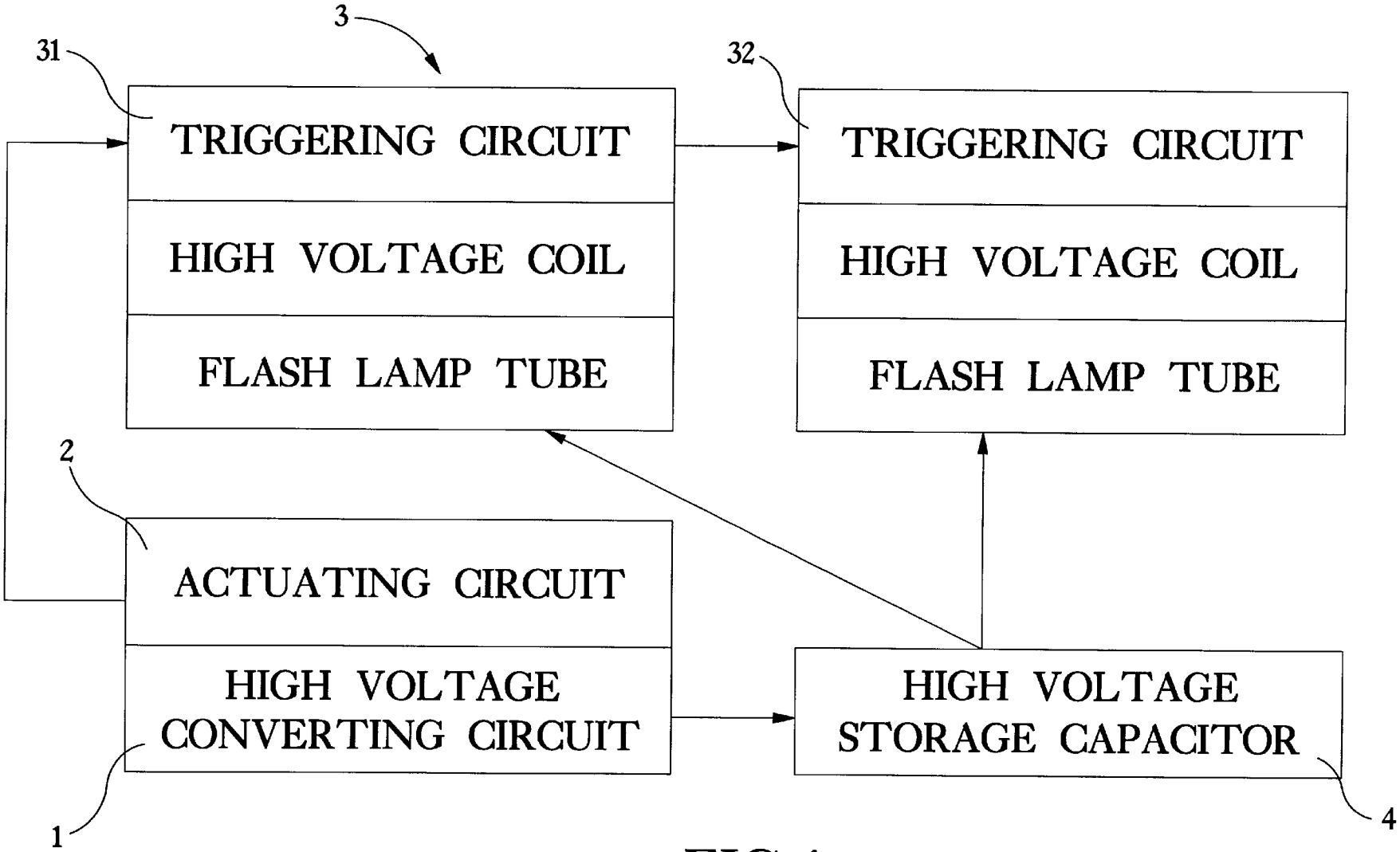
FIG. 4 is a circuit block diagram of the present invention.
Figure 5:
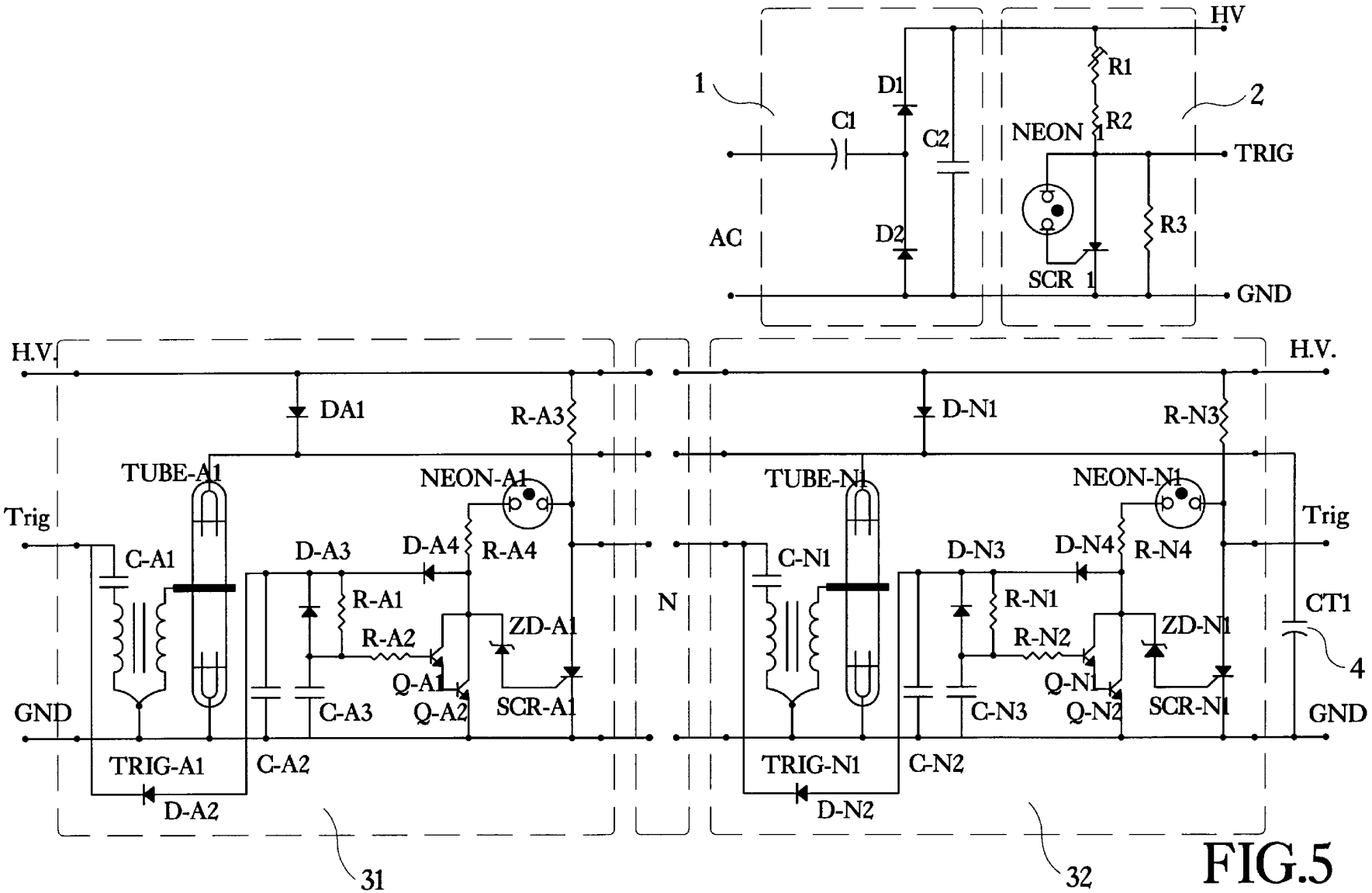
FIG. 5 shows a circuit diagram of the present invention.

Referring to FIGS. 4 and 5, the control device of a flash type movable decorating lamp according to the present invention is illustrated. The control device of a flash type movable decorating lamp according to the present invention includes a high voltage converting circuit 1, an actuating circuit 2, an flash display circuit, 3, a high voltage storage capacitor 4, and other units.

The high voltage converting circuit 1 is formed by rectified diodes D1 and D2, capacitors C1 and C2 and others. The input thereof is connected to an alternative current (AC) or direct current (DC) power source. The output end thereof is connected to the high voltage storage capacitor 4 through a diode DA1 (D–N1).

The high voltage converting circuit I serves to convert the input AC (or DC) power into high voltage DC.

The actuating circuit 2 is formed by resistors R1, R2, and R3, a thyristor (a silicon controlled rectifier) SCR1, a neon lamp NEON1, and other elements. The input thereof is connected to the high voltage converting circuit 1.

The actuating circuit 2 uses the charging property of resistors R1, R2, and R3, and thyristor SCR1 to the high voltage storage capacitor 4 to generate a time difference to the triggering voltage of the neon lamp NEON 1 and thyristor SCR1 (the voltage of this triggering is higher than triggering voltages of flash lamps in the next several stages) as the time period control of flashing in re-actuation.

The flash display circuit 3 is formed by a plurality of flash lamp tube triggering circuits (in this embodiment, two flash lamp tube triggering circuits are installed) which are connected between the actuating circuit 2 and the high voltage storage capacitor 4. The flash lamp tube of each of the flash lamp tube triggering circuit is triggered to display by the triggering circuit in previous stage, and to cause the next stage triggering circuit to be enabled. Then, by the voltage of the high voltage converting circuit 1 to the charging time of the high voltage storage capacitor 4, the actuation of the next stage flash lamp tube triggering circuit is delayed and then it cause the next stage flash lamp tube triggering circuit to be disabled. The circuit and action thereof will be described hereinafter.

Referring to FIG. 5, a high voltage coil TRIG-A1 is installed in the first stage flash lamp tube triggering circuit 31. The next end of the high voltage coil TRIG-A1 is connected to a first capacitor C-A1. The first capacitor is connected to the anode of the thyristor SCR1 of the actuating circuit 2 and is connected to a triggering circuit formed by capacitors C-A1, C-A2, C-A3, resistors R-A1, R-A2, R-A3 and R-A4, diodes D-A3, D-A4, Zener diodes ZD-A1, transistors Q-A1, Q-A2, neon lamp NEON-A1, thyristor SCR-A1. The triggering circuit is connected to the triggering circuit of next stage flash lamp tube triggering circuit 32. The secondary terminal of the high voltage coil TRIG-A1 is connected to a flash lamp tube TUBE-A1. The flash lamp tube TUBE-A1 is connected to the high voltage storage capacitor 4. This connections of the second, third, . . . , Nth flash lamp tube triggering circuits are similar.

As the voltage in the neon lamp NEON-1 of the actuating circuit 2 attained a transferring voltage, the transferring high voltage will charge the capacitor C-A1 of the first stage flash lamp tube triggering circuit 31 so that as the high voltage coil is stimulated, the flash lamp tube TUBE-A1 will flash. Meanwhile, the capacitors C-A2 and C-A3 discharge through diodes D-A2 and D-A3 so that the base of the transistor Q-A1 does not achieve a driving voltage and thus, the collector of the transistor Q-A2 is in a high impedance (enabled).

Then, the DC high voltage will charge the capacitor C-N1 of the next stage flash lamp tube triggering circuit 32 and then apply a voltage to the high voltage coil TRIG-N1 so that as the neon lamp NEON-A1 is in a conductive voltage, the thyristor SCR-A1 can be triggered through resistor R-A4, and Zener diode ZD-A1 so that the high voltage coil TRIG-N1 and flash lamp tube TUBE-N1 actuates, and alternatively, by potential of the Zener diode ZD-A1, and the diode D-A4 to charge the capacitor C-A2, and then the resistor R-A1 to charge the capacitor C-A3, the retaining voltage for conducting transistors Q-A1 and Q-A2 are formed. The resistor R-A2 cause the Darlington circuit formed by transistors Q-A1 and Q-A2 to act so that the collector of the transistor Q-A2 is converted into a low impedance condition (disable) so as to prevent the thyristor SCR-A1 to trigger again. The display of the aforesaid flash lamps is performed stage by stage, until the flash lamp of last stage displays.

When all the flash lamp tube triggering circuits display, all the flash lamp tube triggering circuit are disabled one by one. Thereby, the high voltage storage capacitor 4 will not discharge due to operation of the flash lamp tube. Therefore, the charging voltage of the high voltage storage capacitor 4 will increased continuously to actuate the neon lamp NEON-1 of the actuating circuit 2 and the trigger voltage of the thyristor SCR1 and then the cycle is repeated again to display.

In summary, the circuit of the present invention has the following advantages:

1. The sequential control circuit of a movable decorating lamp can be replaced and part of the storage capacitor and each flash lamp high voltage generating circuit can be used in common so that the circuit is simplified and then the manufacturing process is more economic.
2. All the flash lamp high voltage converting circuits are used in common, as different power system is used, only the high voltage converting circuit is necessary to be updated.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the

What is claimed is:

1. A control device for a movable decorating flash lamp comprising:

a high voltage converting circuit for converting an input voltage into a DC (direct current) voltage of predetermined magnitude;

a high voltage storage capacitor connected to an output end of the high voltage converting circuit;

an actuating circuit connected to the high voltage converting circuit, wherein the actuating circuit uses a property of a high voltage supplied by the high voltage converting circuit to a charging circuit of the high voltage storage capacitor as a time period for control of a next actuation cycle; and a flash display circuit connected between the actuating circuit and the high voltage storage capacitor and formed by a plurality of flash lamp tube triggering circuits which are arranged in stages; each of the flash lamp tube triggering circuits including a respective flash lamp tube; each flash lamp tube being connected to the high voltage storage capacitor; the flash lamp tube of each flash lamp tube triggering circuit being triggered to display by the triggering in a preceding stage, wherein subsequent to display by the flash lamp tube of the flash lamp tube triggering circuit of one stage, the flash lamp tube triggering circuit of a following stage is enabled to cause a display of a respective flash lamp tube corresponding thereto after a delay defined by a charging time of a capacitor of the flash lamp tube triggering circuit of the following stage, the flash lamp tube triggering circuit corresponding to a displayed flash lamp tube being disabled from further actuation until reset by said actuation circuit.

2. The control device for a movable decorating flash lamp as claimed in claim 1, wherein the input voltage is provided by one of alternating current (AC) power or direct current (DC) power.

3. The control device for a movable decorating flash lamp as claimed in claim 1, wherein the actuating circuit includes a thyristor, at least one resistor coupled in series with the thyristor at a node, and a neon lamp coupled between the node and a gate terminal of the thyristor.

4. The control device for a movable decorating flash lamp as claimed in claim 1, wherein each flash lamp tube triggering circuit stage includes a high voltage coil; the high voltage coil has a primary end connected to the capacitor of the flash lamp tube triggering circuit; the capacitor of the flash lamp tube triggering circuit being connected to an output of the actuating circuit and a triggering circuit for the enabling of a following stage; the high voltage coil having a secondary end connected to a corresponding flash lamp tube, and the flash lamp tube being connected to the high voltage storage capacitor.

* * * * *